US010942536B1

(12) United States Patent
Hassan et al.

(10) Patent No.: US 10,942,536 B1
(45) Date of Patent: Mar. 9, 2021

(54) PRE-REGULATOR FOR AN LDO

(71) Applicant: Texas Instruments Incorporated, Dallas, TX (US)

(72) Inventors: Mehedi Hassan, Plano, TX (US); Grant Evan Falkenburg, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 16/674,577

(22) Filed: Nov. 5, 2019

Related U.S. Application Data

(60) Provisional application No. 62/903,632, filed on Sep. 20, 2019.

(51) Int. Cl.
*G05F 1/563* (2006.01)
*G05F 1/46* (2006.01)

(52) U.S. Cl.
CPC ..... *G05F 1/563* (2013.01); *G05F 1/468* (2013.01)

(58) Field of Classification Search
CPC . G05F 1/563; G05F 1/468; G05F 1/59; G05F 1/562; G05F 1/565; G05F 1/575
See application file for complete search history.

(56) References Cited

U.S. PATENT DOCUMENTS 5,982,158 A * 11/1999 Schnars ..... G05F 1/563 323/273
2012/0161733 A1* 6/2012 Hua ..... G05F 1/565 323/282
2013/0076324 A1* 3/2013 Fujii ..... B60R 16/03 323/276
2016/0299518 A1* 10/2016 Iwata ..... G05F 1/468
2017/0351285 A1* 12/2017 Iwata ..... G05F 1/56

* cited by examiner

*Primary Examiner* — Matthew V Nguyen
*Assistant Examiner* — Lakaisha Jackson
(74) *Attorney, Agent, or Firm* — Lawrence J. Bassuk; Charles A. Brill; Frank D. Cimino

(57) ABSTRACT

An electronic device includes a voltage regulator circuit having a power NFET coupled between an upper supply voltage and a pre-regulator output node and a current source coupled in series with a diode element between the upper supply voltage and a lower supply voltage. A gate of the power NFET is coupled to a first node between the current source and a diode element. A bypass circuit includes a power PFET coupled between the upper supply voltage and the pre-regulator output node. A comparison circuit is coupled to turn the bypass circuit off when the upper supply voltage is greater than a regulation threshold voltage.

20 Claims, 9 Drawing Sheets

PRE-REGULATOR FOR AN LDO

PRIORITY UNDER 35 U.S.C. § 119(e) & 37 C.F.R. § 1.78

This non-provisional application claims priority based upon the following prior United States provisional patent application(s): (i) "A PRE-REGULATOR TO EXTEND AN LDO'S INPUT VOLTAGE RANGE," Application No. 62/903,632, filed Sep. 20, 2019, in the name(s) of Mehedi Hassan and Grant Falkenburg, which is hereby incorporated by reference in its entirety.

BACKGROUND

In devices such as a smoke detector, a wide input voltage range is desirable to allow a variety of power sources. For example, a system powered using an alternating current (AC) with conversion to direct current (DC) and a battery backup requires that the device to be operational from a 15 V AC/DC supply as well as from a battery discharged to 2 V. The power source is typically connected to an integrated circuit (IC) that manages the power for the various amplifiers and drivers in the device. An IC that can operate across this wide range of power supply voltages provides many challenges to designers.

SUMMARY

Disclosed embodiments provide a pre-regulator circuit that regulates upper supply voltages that are above a regulation threshold voltage, e.g., 4.0 volts, using a simple clamp diode on the gate of the pass transistor. Clamping the gate ensures that the output voltage will not harm downstream circuits. A bypass switch allows upper supply voltages below the regulation threshold voltage to bypass the regulator. A comparison circuit receives the upper supply voltage and an internally generated reference voltage that are used to open and close the bypass switch. The pre-regulator circuit is simple and may extend an LDO's input voltage without the need for high voltage devices in the LDO.

In one aspect, an embodiment of an electronic device is disclosed. The electronic device includes a voltage regulator circuit comprising a power N-type field effect transistor (NFET) coupled between an upper supply voltage and a pre-regulator output node and a current source coupled in series with a diode element between the upper supply voltage and a lower supply voltage, a gate of the power NFET being coupled to a first node between the current source and the diode element; a bypass circuit comprising a power P-type field effect transistor (PFET) coupled between the upper supply voltage and the pre-regulator output node; and a comparison circuit coupled to turn the bypass circuit off when the upper supply voltage is greater than a regulation threshold voltage.

In another aspect, an embodiment of a method of operating a pre-regulator circuit for a low dropout (LDO) regulator is disclosed. The method includes receiving, at an input node, an upper supply voltage having a range between a lower limit and an upper limit, the upper limit and the lower limit having a difference of at least ten volts; determining whether the upper supply voltage is greater than a regulation threshold voltage; when the upper supply voltage is not greater than the regulation threshold voltage, passing the upper supply voltage directly to a pre-regulator output node that is coupled to the LDO regulator; and when the upper supply voltage is greater than the regulation threshold voltage, regulating the upper supply voltage to provide a regulated output voltage to the pre-regulator output node.

BRIEF DESCRIPTION OF THE DRAWINGS

Embodiments of the present disclosure are illustrated by way of example, and not by way of limitation, in the figures of the accompanying drawings in which like references indicate similar elements. It should be noted that different references to "an" or "one" embodiment in this disclosure are not necessarily to the same embodiment, and such references may mean at least one. Further, when a particular feature, structure, or characteristic is described in connection with an embodiment, it is submitted that it is within the knowledge of one skilled in the art to effect such feature, structure, or characteristic in connection with other embodiments whether or not explicitly described. As used herein, the term "couple" or "couples" is intended to mean either an indirect or direct electrical connection unless qualified as in "communicably coupled" which may include wireless connections. Thus, if a first device couples to a second device, that connection may be through a direct electrical connection, or through an indirect electrical connection via other devices and connections.

The accompanying drawings are incorporated into and form a part of the specification to illustrate one or more exemplary embodiments of the present disclosure. Various advantages and features of the disclosure will be understood from the following Detailed Description taken in connection with the appended claims and with reference to the attached drawing figures in which:

DETAILED DESCRIPTION OF THE DRAWINGS

Specific embodiments of the invention will now be described in detail with reference to the accompanying figures. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In a typical smoke detector that can be powered by either a battery or the mains power supply through an AC/DC converter, a wide range of input supply voltages may be used. For example, the smoke detector may be wired into mains power that is stepped down to 12 volts. When batteries are utilized, either as the main power supply or as a backup power supply, the batteries may be a 9 volt battery or alternatively, two AA batteries may be required to supply 3 volts. An IC chip connected to the input power supply needs to be able to handle this wide range of supply voltages without enduring any reliability issues.

Difficulties are created by the need of devices inside the IC to handle such a wide voltage range because high voltage devices require larger areas and are not suitable for high-speed, low current applications. In particular, a smoke detector must be designed as a low power device. In order to obtain certification from Underwriters Laboratories (UL), a world leader in product safety testing and certification, a non-AC powered smoke detector must have a 10-year lifetime using a 3.3 V lithium battery for household use. Additionally, the circuit must maintain high reliability, even with the potential variability in the input power supply.

Figure 9A:
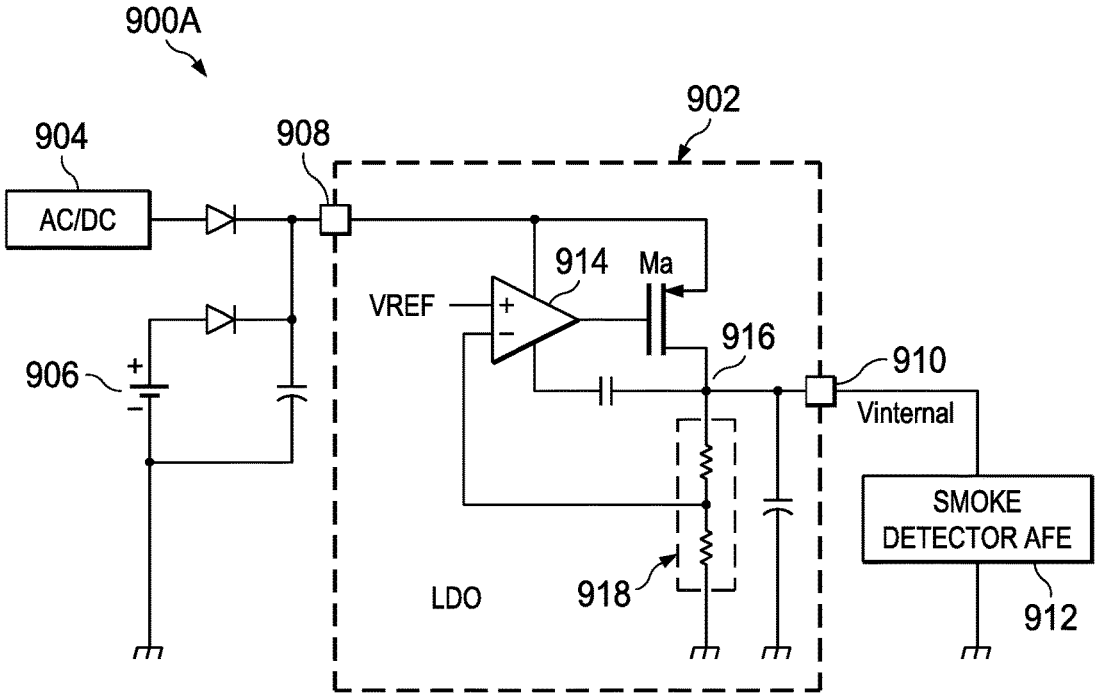
FIG. 9A (PRIOR ART)
FIG. 9A depicts a smoke detector operating with an LDO according to the prior art.
Figure 9B:
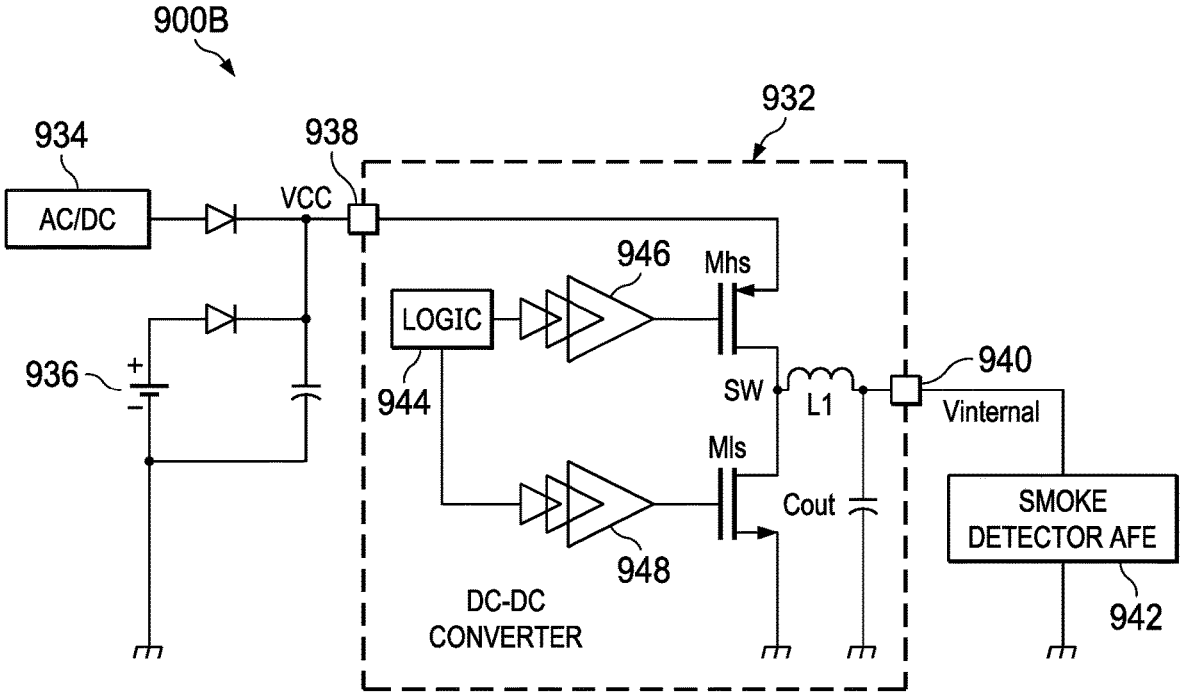
FIG. 9B (PRIOR ART)
FIG. 9B depicts a smoke detector operating with a step-down DC-DC converter according to the prior art.

Most practical applications solve the problem by providing a fixed stepdown DC-DC converter or LDO that steps down from a higher voltage to a fixed, lower voltage so that the internal circuitries of the IC can avoid such wide range of input supply and be designed for the lower voltage. FIGS. 9A and 9B depict two such prior art solutions.

In FIG. 9A, prior art smoke detector 900A includes an LDO regulator 902 that is coupled to receive AC/DC power supply 904 and battery power supply 906 at input node 908 as alternative upper supply voltages. LDO regulator 902 is also coupled to provide an internal supply voltage Vinternal at an output node 910 that is coupled to a smoke detector analog front end (AFE) 912, which can include internal circuits, amplifiers, drivers, etc. LDO regulator 902 includes a power P-type field effect transistor (PFET) Ma that is coupled between the input node 908 and the output node 910 to regulate the internal supply voltage Vinternal that is provided at an output node 910. A differential amplifier 914 is coupled to the input supply voltage and is capacitively coupled to the output node 910. The differential amplifier 914 has a non-inverting input that is coupled to receive a reference voltage Vref. An inverting input of the differential amplifier 914 is coupled to receive feedback from output node 910 through a resistor divider 918 that is coupled between the output node 910 and the lower supply voltage, which can be a ground plane.

In FIG. 9B, prior art smoke detector 900B includes a DC-DC converter 932 that is coupled to receive AC/DC power supply 934 and battery power supply 936 at input node 938 as alternative upper supply voltages. DC-DC converter 932 is also coupled to provide an internal supply voltage Vinternal at an output node 940 that is coupled to a smoke detector AFE 942, which again can include internal circuits, amplifiers, drivers, etc. DC-DC converter 932 includes a high-side power PFET Mhs coupled in series with a low-side power N-type field effect transistor (NFET) MIs between the input node 938 and the lower supply voltage, with a switch node SW positioned between high-side power PFET Mhs and low-side power NFET MIs. An inductor L1 is coupled between switch-node SW and the output node 940, with a capacitor Cout coupled between output node 940 and a lower supply voltage, which can be a ground plane. A logic circuit 944 is coupled to high-side drivers 946, which drive high-side power PFET Mhs and is also coupled to low-side drivers 948, which drive low-side power NFET MIs.

An LDO regulator or DC-DC converter circuit is a dedicated circuit that requires precision reference voltages and bias currents, as well as an amplifier. These requirements cause current consumption to go up. Designing either LDO regulator 902 or DC-DC converter 932 to handle the necessary wide voltage range requires additional silicon area, higher pin counts, and greater power consumption. Additionally, if the output of the LDO regulator 902 or DC-DC converter 932 is fixed to 2 V as a lowest potential power supply, converting an input supply voltage from 15 V to 2 V is highly inefficient. Even converting the input supply voltage from 3.6 V means losing headroom that could be otherwise used. As will be seen below, the disclosed pre-regulator circuit addresses this latter issue by providing a bypass circuit for lower values of the upper supply voltage while regulating the upper supply voltage once the upper supply voltage rises above a regulation threshold voltage.

Figure 1:
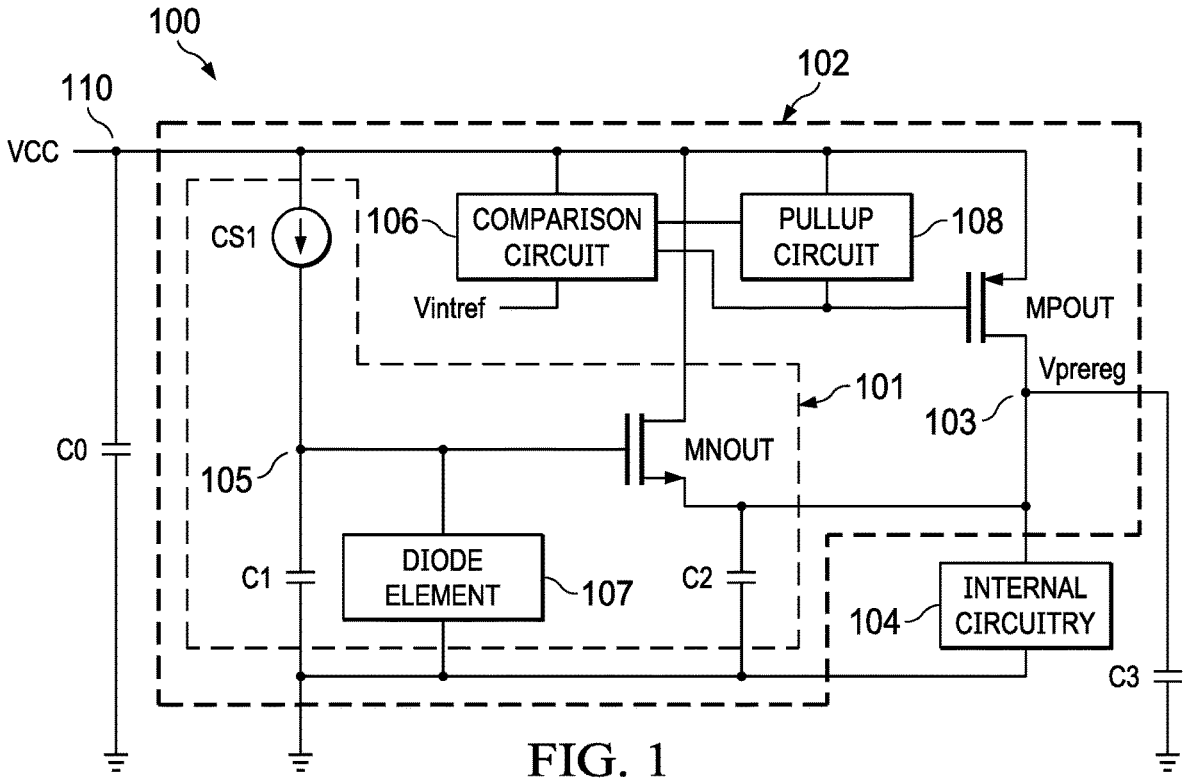
FIG. 1 depicts a high-level block diagram of a pre-regulator circuit according to an embodiment of the disclosure.

FIG. 1 provides a high-level block diagram of a system 100 that includes a pre-regulator circuit 102 that operates to receive the wide range of input voltages and provides an output voltage that operates within a much lower range. Pre-regulator circuit 102 does not provide as great a precision at higher input voltages as either LDO regulator 902 or DC-DC converter 932, but instead utilizes a simple circuit that provides an output voltage that is low enough to prevent damage to the internal circuitry 104, but does not starve the circuits for power. An LDO circuit following pre-regulator circuit 102 does not require high voltage devices and can be designed for low voltages only.

Pre-regulator circuit 102 is coupled between a pre-regulator input node 110, which provides the upper supply voltage VCC, and the lower supply voltage and is also coupled to provide a pre-regulator output voltage Vprereg to internal circuitry 104 for the system 100. The internal circuitry 104 can again contain, e.g., an LDO, drivers, etc. A voltage regulator circuit 101 that includes a power NFET MNOUT operates during a regulation mode to provide a regulated output current when the upper supply voltage VCC is greater than a regulation threshold voltage, which in one embodiment is about 4 V. Voltage regulator circuit 101 also includes a current source CS1, a first capacitor C1 and a diode element 107. Power NFET MNOUT is coupled between the upper supply voltage VCC and a pre-regulator output node 103. Current source CS1 is coupled in series with first capacitor C1 between the upper supply voltage VCC and the lower supply voltage, e.g., the ground plane, with a gate of power NFET MNOUT being coupled to a first node 105 that is between current source CS1 and first capacitor C1. A diode element 107 is coupled between the gate of power NFET MNOUT and the lower supply voltage and during regulation mode will regulate the pre-regulator output voltage Vprereg to a value that is equal to the voltage drop across the diode element minus the gate/source voltage Vgs of power NFET MNOUT. In at least one embodiment, the power NFET MNOUT is a laterally-diffused metal-oxide semiconductor field-effect transistor (LDMOSFET).

A bypass circuit to avoid the voltage regulation of power NFET MNOUT is provided by power PFET MPOUT, which is also coupled between the upper supply voltage VCC and the pre-regulator output node 103. The bypass circuit also includes a comparison circuit that can determine when to turn off the power PFET MPOUT and may further include a pullup circuit 108 to ensure that power PFET MPOUT is turned off quickly. Comparison circuit 106 is powered by the upper supply voltage VCC and also receives an internal reference voltage Vintref. A first output of comparison circuit 106 is coupled to a gate of output PFET MPOUT. In at least one embodiment, pullup circuit 108 is coupled between the upper supply voltage VCC and the gate of power PFET MPOUT and receives a second output of comparison circuit 106.

Comparison circuit 106 compares the upper supply voltage VCC to the internal reference voltage Vintref and may compare either voltages or associated currents. When the upper supply voltage VCC is less than or equal to a regulation threshold voltage, power PFET MPOUT is turned on and passes upper supply voltage VCC to pre-regulator output node 103 with very little voltage lost. This is accomplished by making power PFET MPOUT a large, low on-resistance transistor. When upper supply voltage VCC is greater than the regulation threshold voltage, power PFET MPOUT is turned off so that pre-regulator output voltage Vprereg is regulated by power NFET MNOUT. Where desired, pullup circuit 108 may also be provided in order to ensure that power PFET MPOUT is completely turned off and/or to turn off power PFET MPOUT more quickly.

Figure 2:
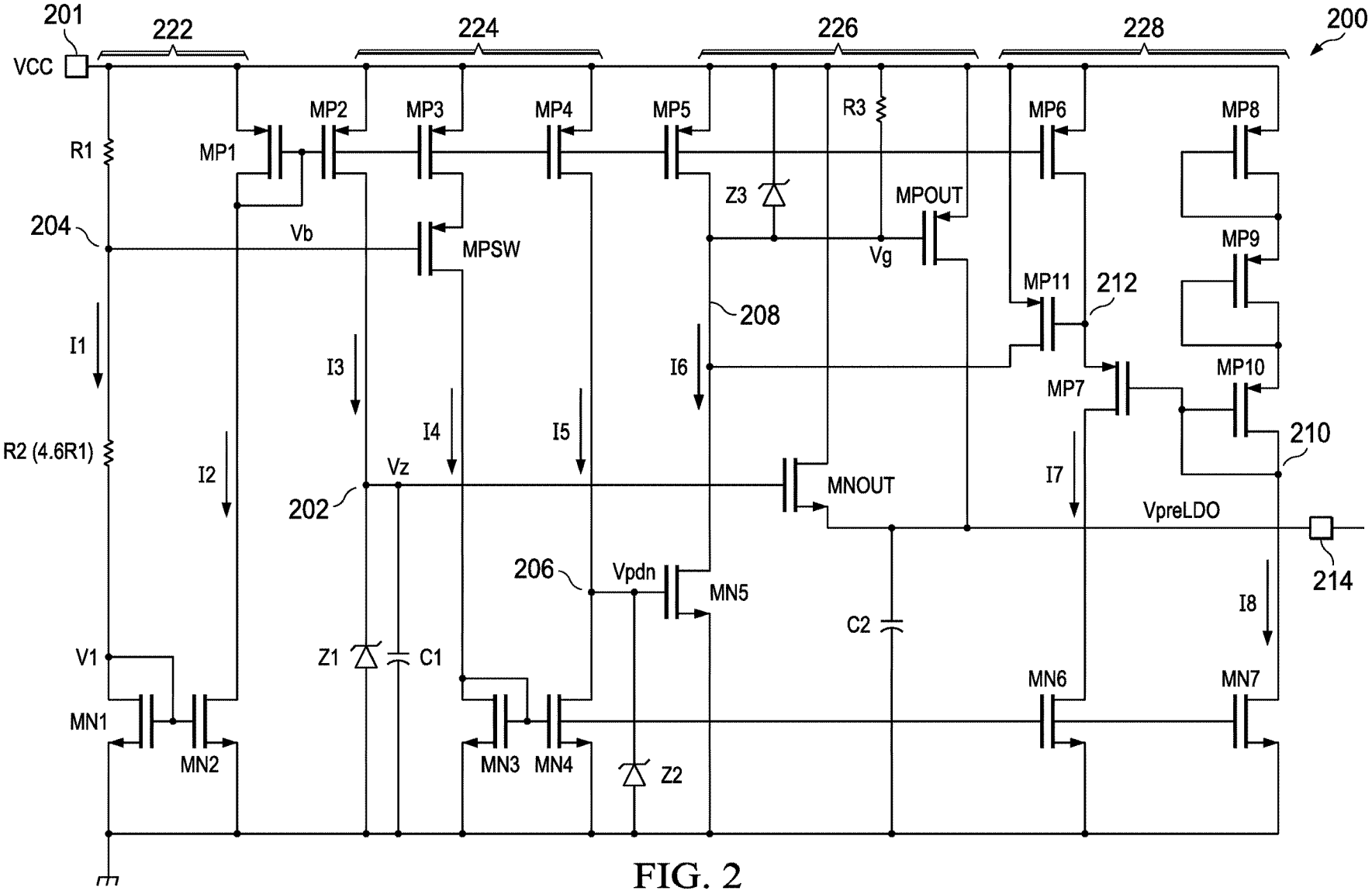
FIG. 2 depicts an implementation of a pre-regulator circuit according to an embodiment of the disclosure.

FIG. 2 depicts a pre-regulator circuit 200, which can be used as a specific implementation of pre-regulator circuit 102. Within pre-regulator circuit 200, a power NFET MNOUT, which in at least one embodiment is an LDMOSFET, is coupled between a pre-regulator input node 201, which provides the upper supply voltage, and the pre-regulator output node 214 and will regulate the voltage in a regulation mode, as will be discussed below. A power PFET MPOUT is also coupled between the pre-regulator input node 201 and the pre-regulator output node 214 to provide a bypass circuit that bypasses regulation through power NFET MNOUT when the upper supply voltage is below a regulation threshold voltage.

Additionally, a first resistor R1 is coupled in series with a second resistor R2 and a first NFET MN1 between the upper supply voltage VCC and the lower supply voltage. The gate and drain of first NFET MN1 are coupled together so that first NFET MN1 acts as a diode. In one embodiment, second resistor R2 is sized to have a resistance that is 4.6 times the resistance of first resistor R1. A first PFET MP1 is coupled in series with a second NFET MN2 between the upper supply voltage VCC and the lower supply voltage. The gate of second NFET MN2 is coupled to the gate of first NFET MN1 and the gate and drain of first PFET MP1 are coupled together. When pre-regulator circuit 200 is turned on, a first current I1 flows through first resistor R1, second resistor R2 and first NFET MN1 and a second current I2 flows through first PFET MP1 and second NFET MN2.

Pre-regulator circuit 200 also includes a second PFET MP2 coupled in series with a diode element that consists of a first Zener diode Z1 between the upper supply voltage VCC and the lower supply voltage, with the gate of power NFET MNOUT coupled to a first node 202 that is between second PFET MP2 and first Zener diode Z1 to receive a gate voltage of Vz. In one embodiment the current mirror formed by first PFET MP1 and second PFET MP2 forms the current source CS1 of FIG. 1. A first capacitor C1 is coupled between the gate of power NFET MNOUT and the lower supply voltage and a second capacitor C2 is coupled between the pre-regulator output node 214 and the lower supply voltage. A third PFET MP3 is coupled in series with a switching PFET MPSW and a third NFET MN3 between the upper supply voltage VCC and the lower supply voltage. A gate of switching PFET MPSW is coupled to a second node 204 between first resistor R1 and second resistor R2 to receive a gate voltage Vb and the gate and drain of third NFET MN3 are coupled together. The gate of second PFET MP2 and the gate of third PFET MP3 are each coupled to the gate of first PFET MP1. When the upper supply voltage is greater than the Zener voltage, which is generally about 5 V, a third current I3 flows through second PFET MP2 and first Zener diode Z1. When switching PFET MPSW is turned on, a fourth current I4 flows through third PFET MP3, switching PFET MPSW and third NFET MN3.

Additionally, a fourth PFET MP4 is coupled in series with a fourth NFET MN4 between the upper supply voltage and the lower supply voltage. The gate of fourth PFET MP4 is coupled to the gate of first PFET MP1 and the gate of fourth NFET is coupled to the gate of third NFET MN3. Also, a fifth PFET MP5 is coupled in series with a fifth NFET MN5 between the upper supply voltage VCC and the lower supply voltage with a fourth node 208 lying between fifth PFET MP5 and fifth NFET MN5. A gate of fifth PFET MP5 is coupled to the gate of first PFET MP1 and the gate of fifth NFET MN5 is coupled to a third node 206 between fourth PFET MP4 and fourth NFET MN4 to receive a gate voltage Vpdn. A second Zener diode Z2 is coupled between the gate of fifth NFET MN5 and the lower supply voltage.

The gate of power PFET MPOUT is coupled to a fourth node 208 between fifth PFET MP5 and fifth NFET MN5 to receive a gate voltage Vg. A third Zener diode Z3 and a third resistor R3 are each coupled between the upper supply voltage and the gate of power PFET MPOUT. Fifth current I5 will flow through fourth PFET MP4 and fourth NFET MN4 when switching transistor MPSW is turned on and a sixth current I6 will flow through fifth PFET MP5 when fifth NFET MN5 is turned on.

Further, a sixth PFET MP6 and a seventh PFET MP7 are coupled in series with a sixth NFET MN6 between the upper supply voltage and the lower supply voltage. A gate of the sixth PFET MP6 is coupled to the gate of the first PFET MP1 and the gate of sixth NFET MN6 is coupled to the gate of third NFET MN3. An eighth PFET MP8, a ninth PFET MP9 and a tenth PFET MP10 are each diode coupled and are further coupled in series with a seventh NFET MN7 between the upper supply voltage and the lower supply voltage. The gate of seventh NFET MN7 is coupled to the gate of third NFET MN3 and the gate of seventh PFET MP7 is coupled to a fifth node 210 between the tenth PFET MP10 and the seventh NFET MN7. When sixth NFET MN6 and seventh PFET MP7 is on, a seventh current I7 flows through sixth PFET MP6, seventh PFET MP7 and sixth NFET MN6. Similarly, when seventh NFET MN7 is on, an eighth current flows through eighth PFET MP8, ninth PFET MP9, tenth PFET MP10 and seventh NFET MN7. Finally, an eleventh PFET MP11 is coupled between the upper supply voltage and the fourth node 208, with a gate of the eleventh PFET MP11 being coupled to a sixth node 212 between sixth PFET MP6 and seventh PFET MP7.

During operation of pre-regulator circuit 200, the first current I1 is a function of the gate/source voltage Vgs of first NFET MN1, the resistance of resistors R1 and R2 and the upper supply voltage VCC. Consequently, in low voltage applications, the first current I1 is small and helps meet the low power requirement. The second current I2 through eighth current I8 are also related to first current I1 through the various current mirrors and hence remain low when upper supply voltage VCC is low.

As seen in the embodiment of pre-regulator circuit 200, the circuit can be generally be divided into four sections: a first section 222 that includes first current I1 and second current I2, a second section 224 that includes third current I3, fourth current I4 and fifth current I5, a third section 226 that includes sixth current I6 and both output circuits, and a fourth section 228 that includes seventh current I7 and eighth current I8. During low-voltage operation, e.g., below 4 V, only first section 222 and third section 226 consume power, as explained in greater detail below. In one embodiment, the simple circuit that is active during low-voltage implementations may use less than 500 nA of power. Only at higher voltages on upper supply voltage VCC, i.e., above a regulation threshold voltage, are second section 224 and fourth section 228 consuming power.

In one embodiment of FIG. 2, for operations below 4.0 volts, first current I1 and second current I2 flow through their respective circuits. Fourth PFET MP4 is on and pulls up third node 206, turning on fifth NFET MN5, so that sixth current I6 flows through. When upper supply voltage VCC is less than the regulation threshold voltage, the difference between the voltage drop across third PFET MP3 and the voltage drop across resistor R1 is such that the gate/source voltage Vgs of switching PFET MPSW is not great enough to allow a substantial current to flow. This means that the current mirror of third NFET MN3 and fourth NFET MN4 is not turned on, and therefore fourth current I4 does not flow.

More specifically with regard to switching PFET MPSW, the gate voltage Vb is equal to (VCC-I1*R1), where R1 here represents the resistance of resistor R1. The voltage across R1 that is required to turn on switching PFET MPSW is Vgsmpsw+Vdsatmp3, were Vgsmpsw is the gate/source voltage of switching PFET MPSW and Vdsatmp3 is the drain/source voltage in saturation of third PFET MP3. At low values of VCC, the gate/source voltage on switching PFET MPSW is not high enough to turn on switching PFET MPSW. Third NFET MN3, fourth NFET MN4, sixth NFET MN6 and seventh NFET MN7 are all off, preventing fourth current I4, fifth current I5, seventh current I7 and eighth current I8 from flowing. While fourth NFET MN4 is off, the fourth PFET MP4 pulls up the third node 206 and fifth NFET MN5 turns on. Fifth NFET MN5 has a higher gate/source voltage than fifth PFET MP5, so fourth node 208 and the gate voltage Vg on power PFET MPOUT are pulled low, fully turning on power PFET MPOUT.

As the voltage of VCC increases, first current I1 increases and I1*R1 increases accordingly. When I1*R1 becomes greater than Vgsmpsw+Vdsatmp3, switching PFET MPSW turns on. The values of I1, R1, Vgsmpsw and Vdsatmp3 can thus be utilized to define the regulation threshold voltage that turns on switching PFET MPSW, so that current I4 flows to third NFET MN3. Because third NFET MN3 is diode coupled and is further coupled to fourth NFET MN4, both fourth current I4 and fifth current I5 flow. Fourth NFET MN4 is designed to be a stronger transistor than fourth PFET MP4, so that third node 206 is pulled low. Third node 206 controls the gate voltage Vpdn for fifth NFET MN5, thereby turning off fifth NFET MN5. With fifth NFET MN5 turned off, fifth PFET MP5 pulls up the gate voltage Vg for power PFET MPOUT to upper supply voltage VCC and turns off power PFET MPOUT.

As upper supply voltage VCC becomes greater than the regulation threshold voltage and power PFET MPOUT is turned off, the source voltage on power NFET MNOUT drops, causing power NFET MNOUT to turn on. Power NFET MNOUT is able to provide a pre-regulator output voltage Vprereg that is equal to the voltage of Zener diode Z1 minus the gate/source voltage Vgs of power NFET MNOUT. The Zener voltage is typically 5V and the gate/source voltage Vgs of power NFET MNOUT is about one volt, so that the pre-regulator output voltage Vprereg through power NFET MNOUT is regulated to about 4 V. As will be seen below, because of variations of process and temperature, the pre-regulator output voltage Vprereg through power NFET MNOUT may in some instances be as high as about 5.4 V. In one embodiment, the maximum gate voltage allowed in the internal circuitry of the smoke alarm is about 6 V, so that the pre-regulator output voltage Vprereg does not need to be controlled quite as tightly as might otherwise be necessary.

When switching transistor MPSW turns fully on and effects the turn-off of power PFET MPOUT, the sixth NFET MN6 and seventh NFET MN7 are also turned on, activating a clamp circuit that includes sixth through eleventh PFETs MP6-MP11. Each of eighth PFET MP8, ninth PFET MP9 and tenth PFET MP10 is diode-coupled, so that the voltage at fifth node 210 is equal to VCC-3*Vgs. The voltage on fifth node 210 is provided to the gate of seventh PFET MP7, turning on seventh PFET MP7 to provide a voltage of VCC-2*Vgs at sixth node 212, which then turns on eleventh PFET MP11. Turning on eleventh PFET MP11 assists in pulling up fourth node 208 so that gate voltage Vg goes high and ensures that power PFET MPOUT is turned off quickly.

Figure 2A:
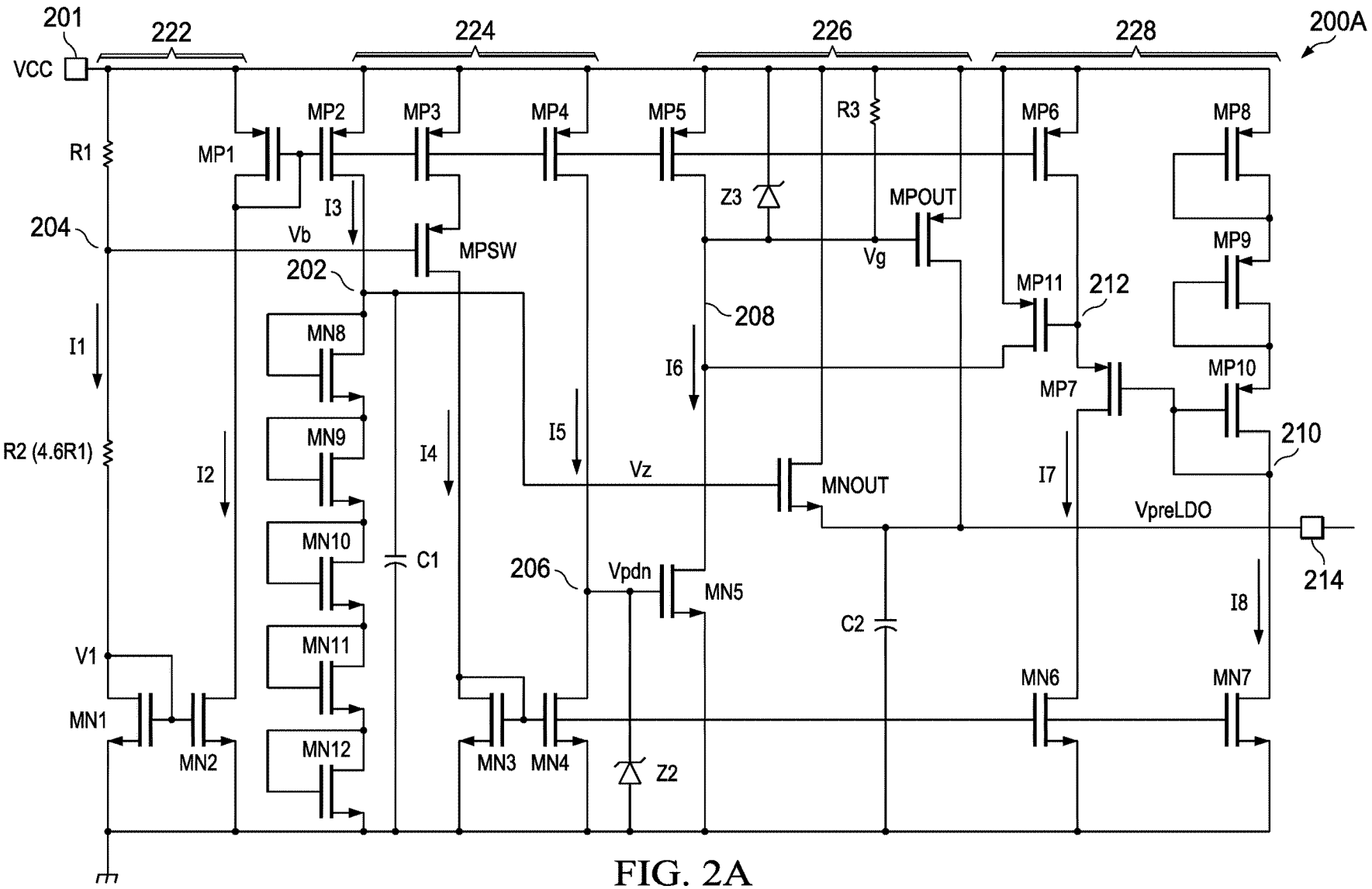
FIG. 2A depicts an implementation of a pre-regulator circuit according to an embodiment of the disclosure.

One skilled in the art will recognize that modifications to the circuit of FIG. 2 can be provided within the spirit of the disclosed pre-regulator circuit 200. Pre-regulator circuit 200A in FIG. 2A depicts one such variation. Pre-regulator circuit 200A is the same as pre-regulator circuit 200 except that the use of Zener diode Z1 as the diode element 107 has been replaced by stacked diode-connected NFETs MN8-MN12 which provide approximately the same limitations to the gate-voltage as does Zener diode Z1, so that pre-regulator circuit 200A provides the same benefits as does pre-regulator circuit 200.

It can be noted that the voltage necessary for the internal circuitry, e.g., internal circuitry 104 in FIG. 1, is very low. Traditional LDOs are generally designed to work across a wide range of both input and output voltages. This is in contrast to the present application in which a wide input range and a low output range are needed. By including two operational modes, e.g., a regulation mode when upper supply voltage VCC is greater than a regulation threshold voltage and a bypass circuit when upper supply voltage VCC is below regulation threshold voltage, the disclosed pre-regulator, e.g., any of pre-regulator circuit 102, pre-regulator circuit 200, and pre-regulator 200A, is able to stepdown voltage with a simpler design.

Use of the disclosed pre-regulator may result in one or more of the following advantages:

- The circuit requires no external reference circuits or current sources;
- There is very low current consumption during Li-ION battery applications at nominal temperatures and process, thus an allowing extended battery life for smoke detector applications;
- For upper voltage supply VCC of less than the regulation threshold voltage, the power PFET acts as a switch and transfers VCC directly to the pre-regulator output node;
- There is negligible voltage drop on the power PFET during Li-ION battery application;

Once the upper supply voltage VCC is above the regulation threshold voltage, the pre-regulator output is controlled by the gate voltage Vz on power NFET MNOUT, which is limited by a Zener voltage; the pre-regulator output voltage Vprereg is equal to gate voltage Vz minus the gate/source voltage Vgs of power NFET MNOUT and once the output reaches this value, the regulated output remains constant for an upper supply voltage VCC as high as 15 V.

Figure 3:
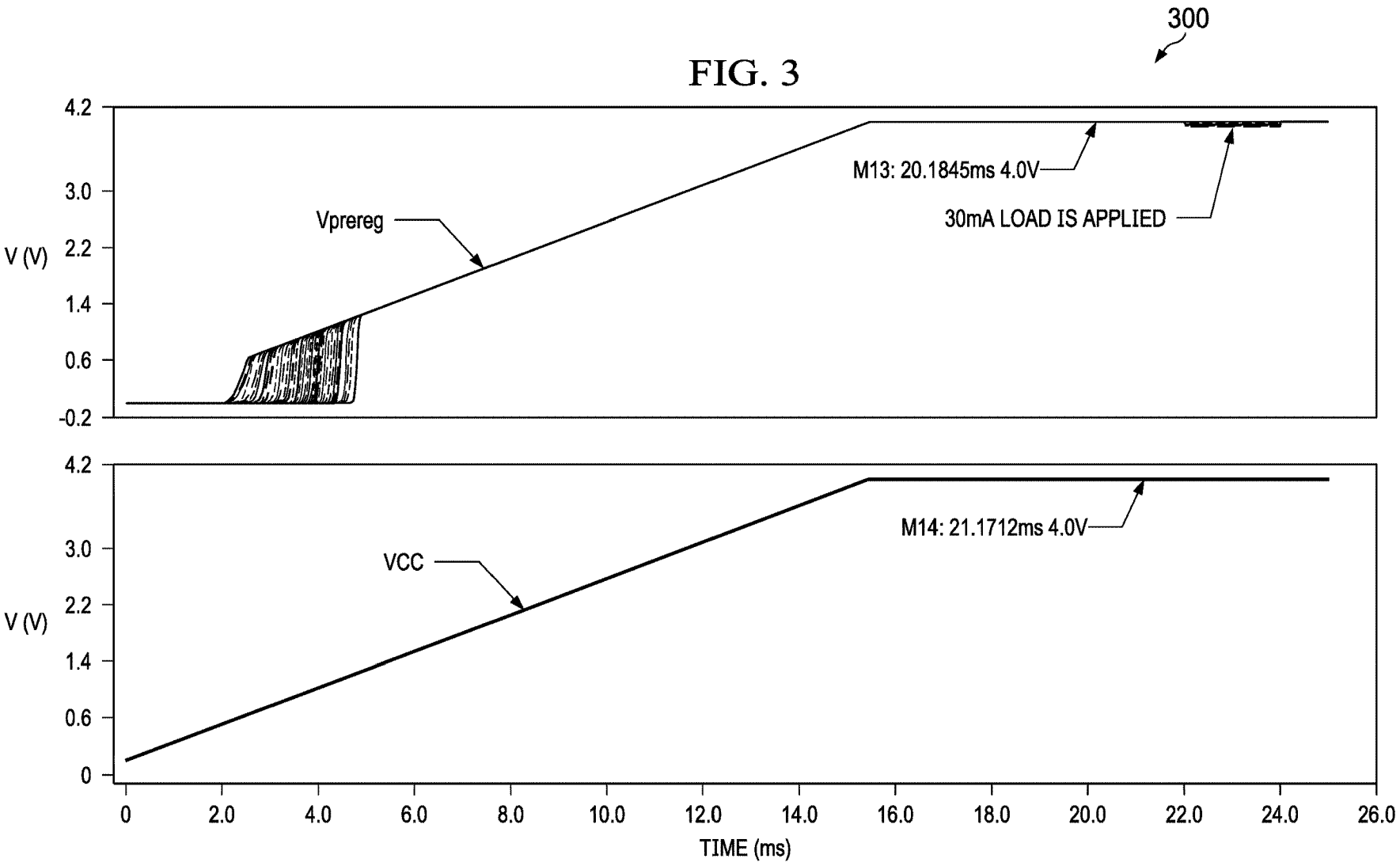
FIG. 3 depicts the input and output voltages as the pre-regulator circuit powers up with an input voltage of 4 V and a load is applied according to an embodiment of the disclosure.

FIG. 3 depicts a graph 300 of the simulated values of upper supply voltage VCC and pre-regulator output voltage Vprereg as the circuit is turned on with an upper supply voltage of 4 V and then as a 30 mA load is applied. The simulations include variations across temperature and transistor parameters. As the circuit is turned on, upper voltage supply VCC climbs steadily in all embodiments until VCC reaches 4 V. Different simulations require slightly different amounts of time for pre-regulator output voltage Vprereg to begin to rise, although all of the simulations quickly accomplish a steady rise to a pre-regulator output voltage Vprereg of 4 V. When a 30 mA load is applied, a small amount of separation of pre-regulator output voltage Vprereg is seen. When the load is removed, all of the simulations return to a steady output of 4 V. At a current of 30 mA, the pre-regulator output voltage Vprereg ranged between a minimum of 3.9348 V to a maximum of 3.956 V, with a typical voltage of 3.95 V. When the current is less than 1 μA, the pre-regulator output voltage Vprereg ranged between a minimum of 3.999 V to a maximum of 4.0 V, with a typical voltage of 3.999 V.

Figure 4:
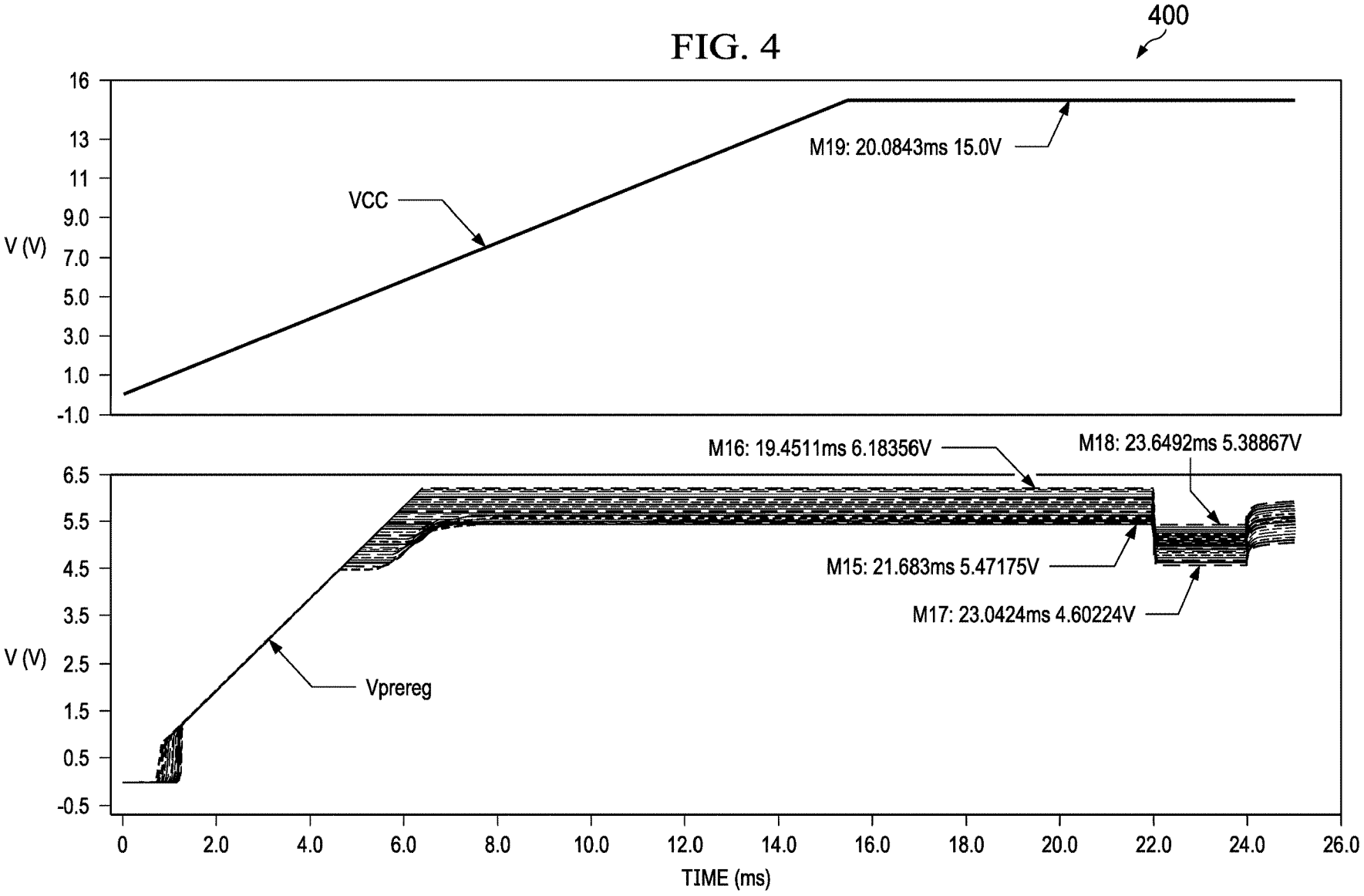
FIG. 4 depicts the input and output voltages as the pre-regulator circuit powers up with an input voltage of 15 V and a load is applied according to an embodiment of the disclosure.

FIG. 4 depicts a graph 400 of the simulated values of upper supply voltage VCC and pre-regulator output voltage Vprereg as the circuit is turned on with an upper supply voltage of 15 V and then again as a 30 mA load is applied. The simulations again include variations across temperature and transistor parameters. At circuit turn-on, upper voltage supply VCC climbs steadily in all embodiments until VCC reaches 15 V. After some small variations in time for pre-regulator output voltage Vprereg to begin to climb, the steady state of pre-regulator output voltage Vprereg shows greater variation at the maximum voltage than when the upper supply voltage is simply passed through, both before and after application of a 30 mA load. At a current of 30 mA, the pre-regulator output voltage Vprereg ranged between a minimum of 3.935 V to a maximum of 3.956 V, with a typical voltage of 3.945 V. When the current is less than 1 μA, the pre-regulator output voltage Vprereg ranged between a minimum of 3.999 V to a maximum of 4.0 V, with a typical voltage of 3.999 V.

Figure 5:
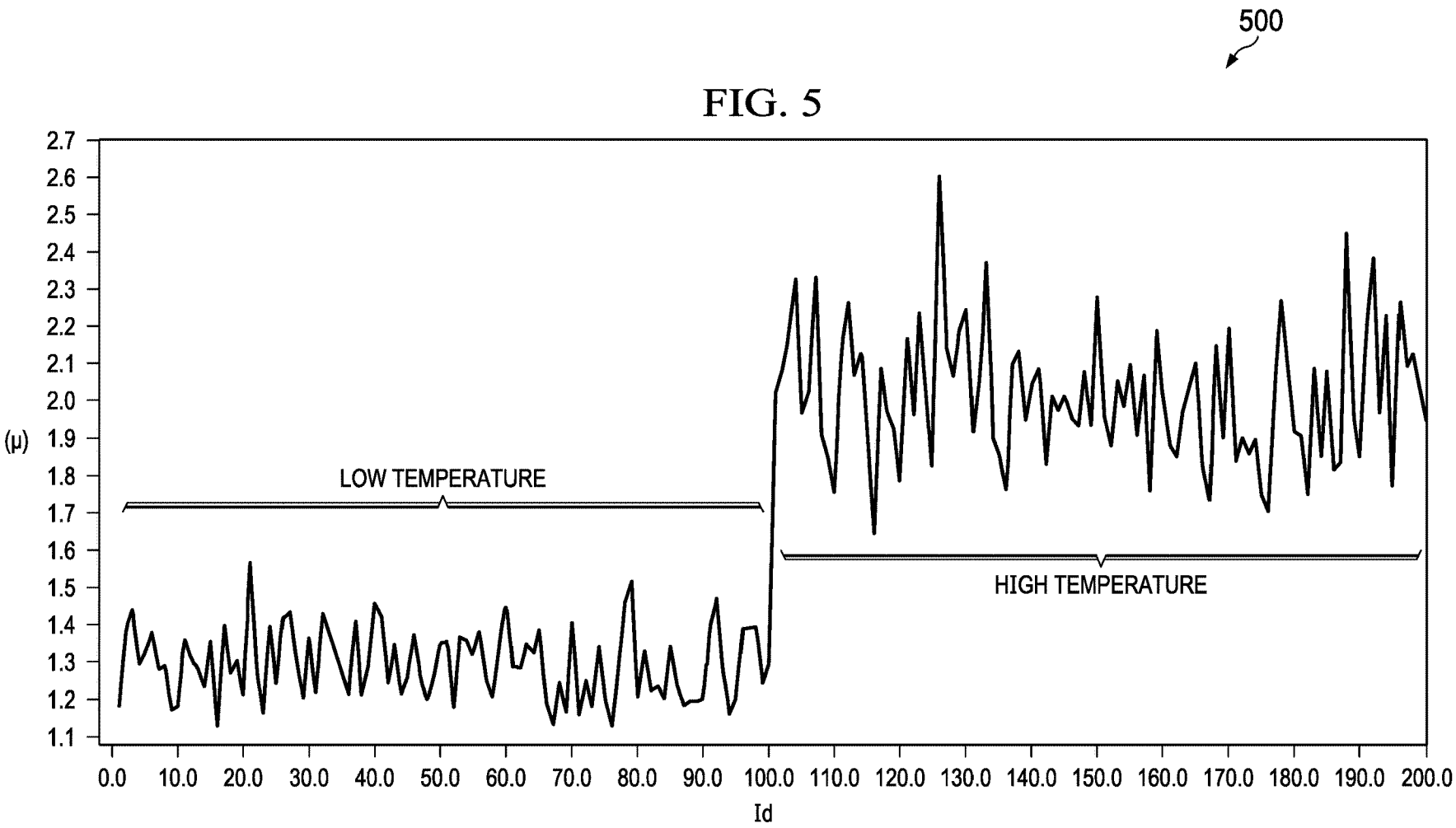
FIG. 5 depicts the quiescent current of the pre-regulator circuit at both low and high temperatures when operating at an input voltage of 4 V according to an embodiment of the disclosure.

FIG. 5 depicts graph 500 of the total quiescent current consumed by pre-regulator circuit 200 across variations in process and temperatures ranging from 0-85° C. at an upper supply voltage VCC of 4 V. The low temperature range is shown on the left-hand side of graph 500 where the quiescent current averaged 1.13 μA and the high temperature range is shown on the right-hand side, where the quiescent current averaged 2.62 μA. A typical quiescent current is 1.66 μA.

Figure 6:
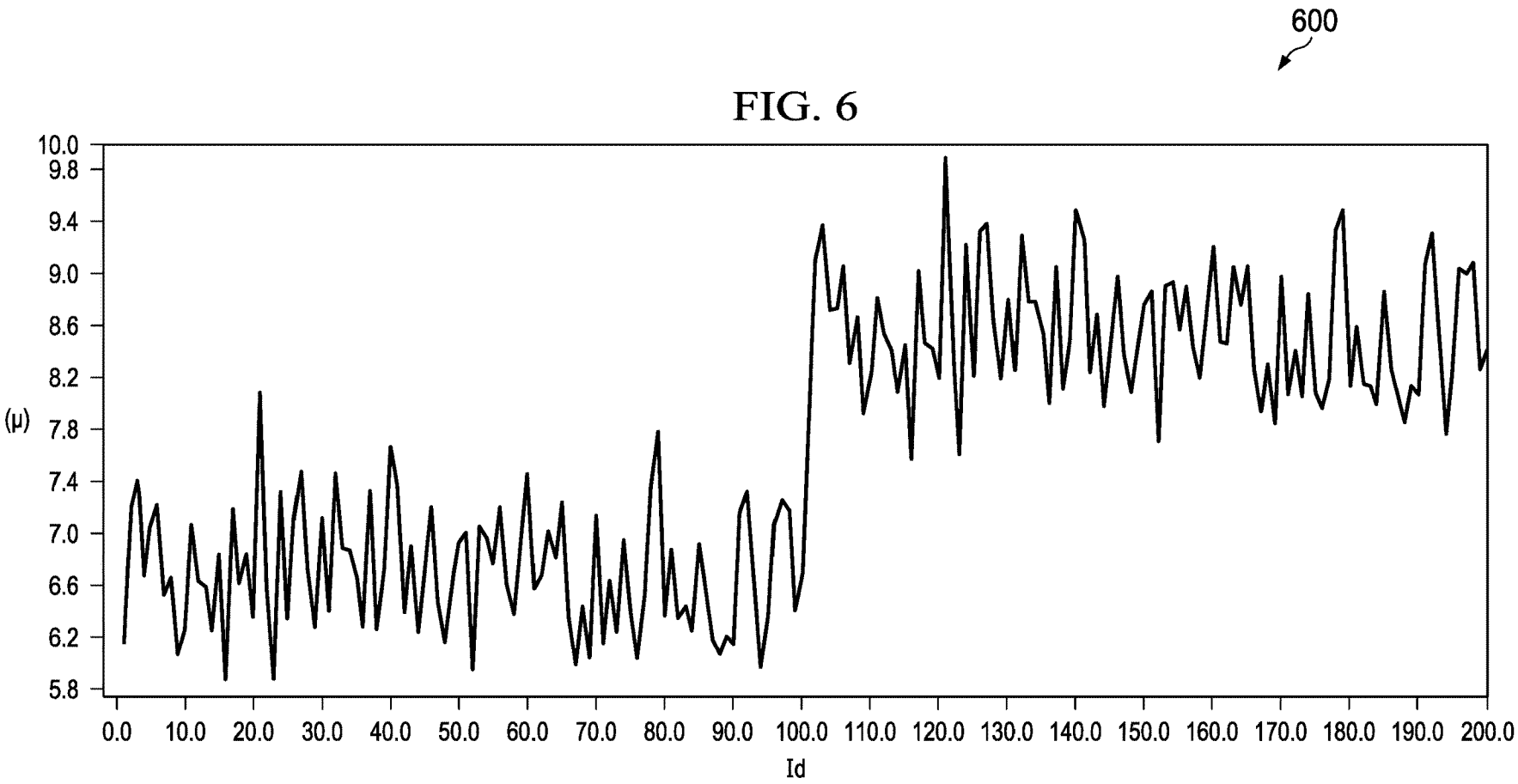
FIG. 6 depicts the quiescent current of the pre-regulator circuit at both low and high temperatures when operating at an input voltage of 15 V according to an embodiment of the disclosure.

FIG. 6 similarly depicts a graph 600 of the total quiescent current consumed by pre-regulator circuit 200 across variations in process and temperatures ranging from 0-85° C. at an upper supply voltage VCC of 15 V. Again, the low temperature range is shown on the left-hand side of graph 600 where the quiescent current averaged 5.88 μA and the high temperature range is shown on the right-hand side, where the quiescent current averaged 9.88 μA. A typical quiescent current at an upper supply voltage VCC of 15 V is 7.63 μA. While the quiescent current at 15 V is not as favorable as the quiescent current at 4 V, when the circuit is receiving 15 V, the system is generally using mains power and the need to minimize the current is not as critical as when battery power is being employed.

Figure 7:
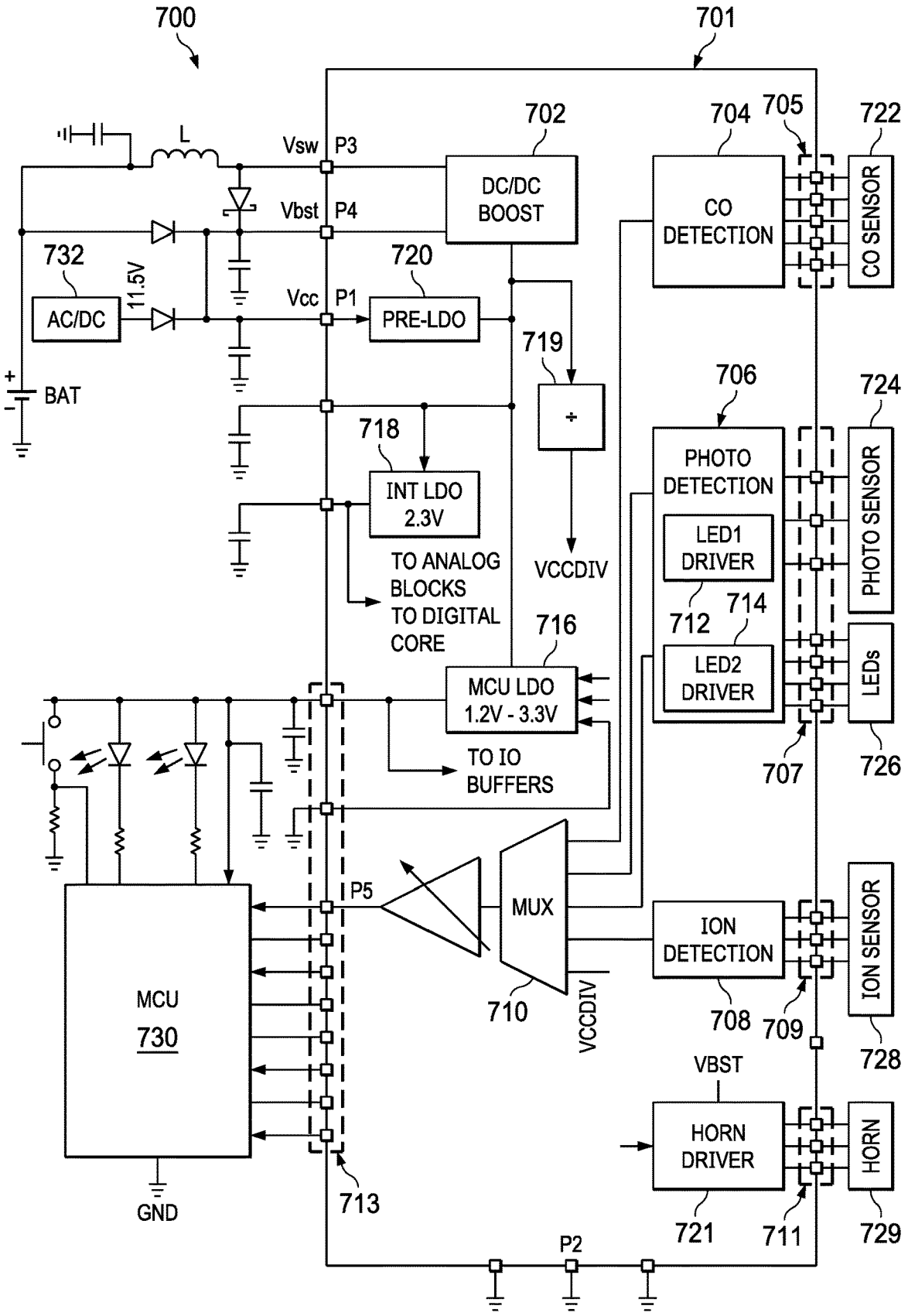
FIG. 7 depicts a block diagram of a smoke detector that utilizes a pre-regulator circuit according to an embodiment of the disclosure.

FIG. 7 depicts a block diagram of an electronic device that is a smoke detector 700 incorporating a pre-regulator circuit (pre-LDO) 720 according to an embodiment of the disclosure. Smoke detector 700 includes an IC chip 701 on which a number of circuits are implemented, including pre-regulator circuit 720, which can be implemented using the circuits shown in one of pre-regulator circuit 102 and the pre-regulator circuit 200 and the method(s) as will be discussed in FIG. 8. IC chip 701 also includes a carbon monoxide detection circuit 704, a photo-detection circuit 706, an optional ion detection circuit 708, and a horn driver 721. In one embodiment, photo-detection circuit 706 also includes a first light-emitting diode (LED) driver 712 and a second LED driver 714. Carbon monoxide detection circuit 704 is coupled to a first plurality of pins 705; photo-detection circuit 706 is coupled to a second plurality of pins 707; and horn driver 721 is coupled to a third plurality of pins 711. Multiplexor 710, which is coupled to a fifth pin P5 that is part of a fourth plurality of pins 713, can receive input signals from each of carbon monoxide detection circuit 704 and photo-detection circuit 706. When optional ion detection circuit 708 is provided, ion detection circuit 708 is coupled to a fifth plurality of pins 709 and multiplexor 710 is also coupled to receive input signals from ion detection circuit 708. Horn driver 721 can be provided to drive a horn 729.

Four specific power supply pins are noted in IC chip 701: first pin P1, second pin P2, third pin P3 and fourth pin P4. A pre-regulator circuit 720 is coupled to first pin P1, which is also coupled to an AC/DC converter 732. Pre-regulator circuit 720 is also coupled to second pin P2 (coupling not specifically shown) to receive a lower supply voltage. A DC/DC boost converter 702 is coupled to third pin P3 to receive power from battery BAT through an inductor L and is also coupled to fourth pin P4 to provide a boosted output voltage Vbst from the battery power. Fourth pin P4 is also coupled to first pin P1, which provides the boosted output voltage Vbst to pre-regulator circuit 720 when battery power is relied on. Second pin P2 is coupled to a ground plane, although the internal connections to the circuits are not specifically shown.

Pre-regulator circuit 720 provides a pre-regulator output voltage Vprereg, which will be used to provide the gate-driver supply voltage Vcc for internal circuits on IC chip 701. The pre-regulator output voltage Vprereg can be distributed to microcontroller (MCU) LDO regulator 716, internal LDO regulator 718 and Vcc divider 719. MCU LDO regulator 716 provides a supply voltage to MCU 730 and the I/O buffers (not specifically shown); internal LDO regulator 718 provides a supply voltage to internal circuits such as the data core and the analog blocks, e.g., the carbon monoxide detection circuit 704, photo-detection circuit 706 and ion detection circuit 708; and Vcc divider 719 provides a supply voltage to multiplexor 710.

In smoke detector 700, carbon monoxide detection circuit 704 is coupled to carbon monoxide sensor 722 through the first plurality of pins 705; photo-detection circuit 706, which can include first LED driver 712 and second LED driver 714, is coupled to photo sensor 724 and LEDs 726 through the second plurality of pins 707; ion detection circuit 708 is coupled to ion sensor 728 through the fifth plurality of pins 709; and horn driver 721 is coupled to a horn 729 through the third plurality of pins 711. The carbon monoxide sensor 722, photo sensor 724 and ion sensor 728 collect the information needed to detect smoke and carbon monoxide in the area, while horn 729 provides a loud audible alert when smoke or carbon monoxide are detected. IC chip 701 is also coupled to microcontroller 730 though the fourth plurality of pins 713, with IC chip 701 supplying both power and information to microcontroller 730 and receiving instructions to control various aspects of operation of smoke detector 700. The fifth pin P5, which is part of the fourth plurality of pins 713, provides a path for the multiplexor 710 to provide the outputs of the carbon monoxide detection circuit 704, photo-detection circuit 706, and ion detection circuit 708 to MCU 730.

Figure 8:
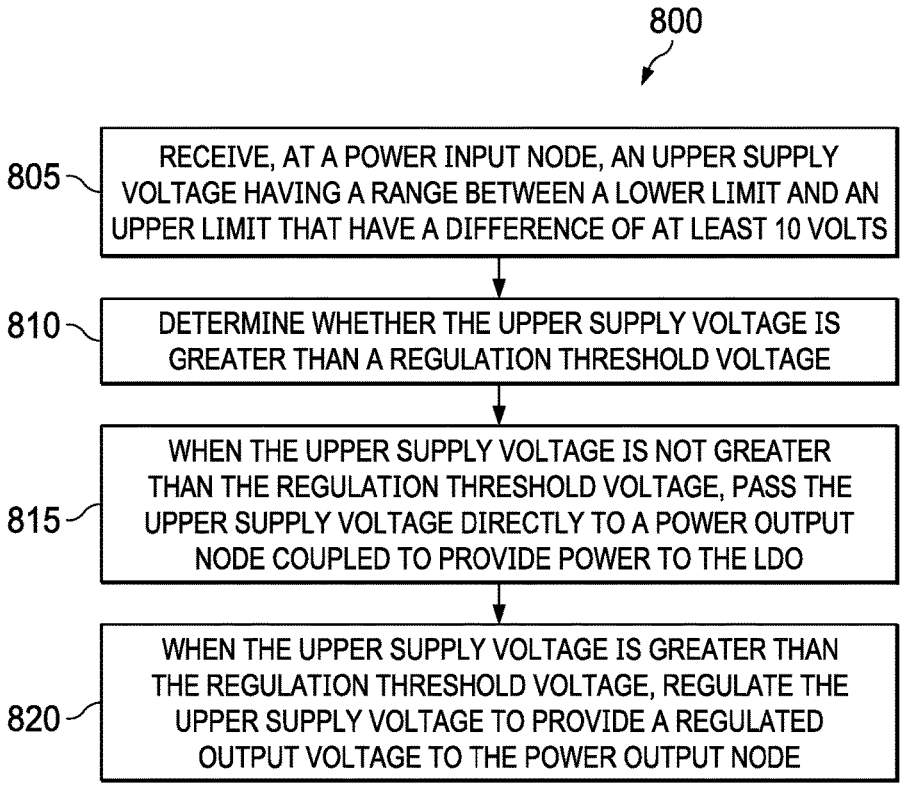
FIG. 8 depicts a method of operating a pre-regulator circuit for an LDO regulator according to an embodiment of the disclosure.

FIG. 8 depicts a method 800 of operating a pre-regulator circuit for an LDO regulator. The method begins with receiving 805, at a power input node, an upper supply voltage that has a range between a lower limit and an upper limit that have a difference of at least ten volts. In one embodiment, the lower limit is about 3.3 V and the upper limit is about 15 V, so that the difference is about 12 volts. The method determines 810 whether the upper supply voltage is greater than a regulation threshold voltage. In one embodiment, the regulation threshold voltage is about 4 V. When the upper supply voltage is not greater than the regulation threshold voltage, the upper supply voltage is passed 815 directly to a power output node coupled to provide power to the LDO regulator. When the upper supply voltage is greater than the regulation threshold voltage, the method regulates 820 the upper supply voltage to provide a regulated voltage to the power output node Applicants have disclosed an electronic device and a method that extends an LDO regulator's input voltage without the need for high voltage devices by providing a pre-regulator circuit. The electronic device may be a circuit, an IC chip, or a system, e.g., a smoke detector. The pre-regulator circuit consumes very little current when low-voltage battery input is provided, is very suitable for battery applications and provides maximum battery voltage to the LDO regulator. The pre-regulator circuit does not require an external bias current or reference voltage to function. The same resistor that generates the bias current can be used to switch from a PMOS pass FET to an LDMOSFET when VCC crosses a regulation threshold voltage.

Although various embodiments have been shown and described in detail, the claims are not limited to any particular embodiment or example. None of the above Detailed Description should be read as implying that any particular component, element, step, act, or function is essential such that it must be included in the scope of the claims. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein by reference and are intended to be encompassed by the present claims. Accordingly, those skilled in the art will recognize that the exemplary embodiments described herein can be practiced with various modifications and alterations within the spirit and scope of the claims appended below.

What is claimed is:

1. An electronic device comprising:

a voltage regulator circuit comprising a power N-type field effect transistor (NFET) coupled between an upper supply voltage and a pre-regulator output node and a current source coupled in series with a diode element between the upper supply voltage and a lower supply voltage, a gate of the power NFET being coupled to a first node between the current source and the diode element;

a bypass circuit comprising a power P-type field effect transistor (PFET) coupled between the upper supply voltage and the pre-regulator output node; and a comparison circuit coupled to turn the bypass circuit off when the upper supply voltage is greater than a regulation threshold voltage.

2. The electronic device as recited in claim 1 wherein the voltage regulator circuit further comprises a first capacitor coupled between the gate of the power NFET and the lower supply voltage; and a second capacitor coupled between a source of the power NFET and the lower supply voltage.

3. The electronic device as recited in claim 1 wherein the diode element comprises a first Zener diode.

4. The electronic device as recited in claim 3 wherein the comparison circuit comprises:

a first resistor and a second resistor coupled in series with a first NFET between an upper supply voltage and a lower supply voltage; and a first PFET coupled in series with a second NFET between the upper supply voltage and the lower supply voltage, the first PFET having a gate and a drain coupled together;

wherein a second PFET has a gate coupled to the gate of the first PFET to form the current source.

5. The electronic device as recited in claim 4 wherein the comparison circuit further comprises:

a third PFET coupled in series with a switching PFET and a third NFET between the upper supply voltage and the lower supply voltage, a gate of the third PFET being coupled to the gate of the first PFET, a gate of the third NFET being coupled to a drain of the third NFET, and a gate of the switching PFET being coupled to a second node between the first resistor and the second resistor;

a fourth PFET coupled in series with a fourth NFET between the upper supply voltage and the lower supply voltage, a gate of the fourth PFET being coupled to the gate of the first PFET and a gate of the fourth NFET being coupled to the gate of the third NFET;

a fifth PFET coupled in series with a fifth NFET between the upper supply voltage and the lower supply voltage, a gate of the fifth PFET being coupled to the gate of the first PFET, a gate of the fifth NFET being coupled to a third node between the fourth PFET and the fourth NFET, and a gate of the output PFET being coupled to a fourth node between the fifth PFET and the fifth NFET;

a second Zener diode coupled between the gate of the fifth NFET and the lower supply voltage;

a third Zener diode coupled between the upper supply voltage and the gate of the power PFET; and a third resistor coupled between the upper supply voltage and the gate of the power PFET.

6. The electronic device as recited in claim 1 further comprising a pullup circuit coupled between the upper supply voltage and the gate of the power PFET, the pullup circuit being coupled to be controlled by the comparison circuit.

7. The electronic device as recited in claim 6 wherein the pullup circuit comprises:

a sixth PFET coupled in series with a seventh PFET and a sixth NFET between the upper supply voltage and the lower supply voltage, a gate of the sixth PFET being coupled to the gate of the first PFET and a gate of the sixth NFET being coupled to the gate of the third NFET;

an eighth PFET coupled in series with a ninth PFET, a tenth PFET and a seventh NFET between the upper supply voltage and the lower supply voltage, a gate of the eighth PFET being coupled to a drain of the eighth PFET, a gate of the ninth PFET being coupled to a drain of the ninth PFET, a gate of the tenth PFET being coupled to a drain of the tenth PFET and to a gate of the seventh PFET, and a gate of the seventh NFET being coupled to the gate of the third NFET; and an eleventh PFET coupled between the upper supply voltage and the fourth node, a gate of the eleventh PFET being coupled to a sixth node between the sixth PFET and the seventh PFET.

8. The electronic device as recited in claim 1 wherein the electronic device comprises an integrated circuit (IC) chip on which the voltage regulator circuit, the bypass circuit and the comparison circuit are fabricated.

9. The electronic device as recited in claim 8 wherein the IC chip further comprises an LDO regulator coupled to provide power to at least one circuit.

10. The electronic device as recited in claim 9 wherein the IC chip further comprises:

a first pin for coupling to an AC/DC converter;

a second pin for coupling to a ground plane;

a third pin for coupling to a battery; and a fourth pin for providing a boosted output voltage from the battery.

11. The electronic device as recited in claim 10 wherein the IC chip further comprises:

a carbon monoxide detection circuit coupled to a first plurality of pins;

a photo-detection circuit coupled to a second plurality of pins;

a horn driver coupled to a third plurality of pins; and a multiplexor coupled to receive outputs from the carbon monoxide detection circuit and the photo-detection circuit, the multiplexor further coupled to a fifth pin for communicating the outputs.

12. The electronic device as recited in claim 11 wherein the electronic device comprises a smoke detector, the smoke detector further comprising:

a carbon monoxide sensor coupled to the first plurality of pins;

a photo sensor coupled to the second plurality of pins;

a horn coupled to the third plurality of pins; and a microcontroller coupled to a fourth plurality of pins of the IC chip, the fourth plurality of pins comprising the fifth pin.

13. The electronic device as recited in claim 11 wherein the IC chip further comprises an ion detection circuit coupled to a fifth plurality of pins, the multiplexor being further coupled to receive outputs from the ion detection circuit.

14. The electronic device as recited in claim 13 wherein the electronic device comprises a smoke detector, the smoke detector further comprises an ion sensor coupled to the fifth plurality of pins.

15. A method of operating a pre-regulator circuit for a low dropout (LDO) regulator, the method comprising:

receiving, at a pre-regulator input node, an upper supply voltage having a range between a lower limit and an upper limit, the upper limit and the lower limit having a difference of at least ten volts;

determining whether the upper supply voltage is greater than a regulation threshold voltage;

when the upper supply voltage is not greater than the regulation threshold voltage, passing the upper supply voltage directly to a pre-regulator output node that is coupled to the LDO regulator; and when the upper supply voltage is greater than the regulation threshold voltage, regulating the upper supply voltage to provide a regulated output voltage to the pre-regulator output node.

16. The method as recited in claim 15 wherein regulating the upper supply voltage comprises using a diode element to limit a gate voltage of a power NFET.

17. The method as recited in claim 16 further comprising using an N-type LDMOSFET as the power NFET.

18. The method as recited in claim 15 wherein the lower limit is about two volts and the upper limit is about fifteen volts.

19. The method as recited in claim 18 wherein the regulation threshold voltage is about four volts.

20. The method as recited in claim 15 wherein the regulated output voltage is constant for input voltages greater than the regulation threshold voltage.

* * * * *